United States Patent [19]

Eberle

[11] Patent Number: 4,731,942

[45] Date of Patent: Mar. 22, 1988

[54] DOZER BLADE

[76] Inventor: Ronald D. Eberle, 495 Oak St., Grainfield, Kans. 67737

[21] Appl. No.: 1,184

[22] Filed: Jan. 7, 1987

[51] Int. Cl.[4] ..... E01H 5/06

[52] U.S. Cl. ..... 37/272; 37/266

[58] Field of Search ..... 37/266, 272, 274, 276, 37/DIG. 3, DIG. 12

[56] References Cited

U.S. PATENT DOCUMENTS

| | | | |
|---|---|---|---|
| Re. 20,125 | 10/1936 | Frink . | |
| 745,608 | 12/1903 | Heermans . | |
| 801,090 | 10/1905 | Kenney . | |
| 990,002 | 4/1911 | Pillionnel et al. | 37/272 |
| 1,197,779 | 9/1916 | Stenson | 37/274 |
| 1,534,638 | 4/1925 | Ebert | 37/272 |
| 1,561,651 | 11/1925 | Lavell . | |
| 1,589,748 | 6/1926 | Frink | 37/277 |
| 1,794,070 | 2/1931 | Frink | 37/274 X |
| 1,929,548 | 10/1933 | Frink . | |
| 2,315,743 | 4/1943 | Sieg . | |
| 3,248,811 | 5/1966 | Pravednekow . | |
| 4,074,448 | 2/1978 | Niemela | 37/272 X |
| 4,445,577 | 5/1984 | Russell et al. | 37/217 X |

OTHER PUBLICATIONS

"Roads and Streets", Oct. 1963, Wausau Snow Plow Advertisement.

*Primary Examiner*—Edgar S. Burr
*Assistant Examiner*—Joseph McCarthy
*Attorney, Agent, or Firm*—Litman, McMahon & Brown

[57] ABSTRACT

A dozer blade of the present invention includes two curved blade sections that are joined at respective inner ends thereof. The blade sections are joined to form a unitary blade exhibiting a concave surface for scraping and removal of snow and the like. The blade sections converge forwardly at the top toward their central juncture such that a top portion of the central juncture is generally positioned forwardly of a bottom portion thereof. Additionally, the top portion of the central juncture is generally positioned lower than outer ends of respective top portions of the blade sections, presenting a winged profile from the front. A divider is positioned along the central juncture from a bottom scraping portion of the blade sections to the top. The divider serves to distribute material being dozed generally equally to either side.

6 Claims, 5 Drawing Figures

DOZER BLADE

BACKGROUND OF THE INVENTION

The present invention relates to blades for dozing materials and more particularly to blades designed to plow snow.

Dozer blades are well known in the art, and many have been particularly adapted to push, or plow, snow. In most situations, snow plows and the like are utilized in a commercial sense by various governmental bodies or private entrepreneurs. In either event, a high priority, in addition to effective clearing of the snow, is to reduce the costs involved in operating the plowing device. Thus, many attachment-type arrangements have been developed for multi-use vehicles. When the plowing vehicle is a large truck or the like, the efficient action of a snow plow on a surface is not as important as when a smaller vehicle, such as a jeep-type vehicle, is being utilized. The smaller vehicles do not have as much power as the larger trucks, nor do they have comparable structural integrity that can withstand high vibration and the like. Heretofore, adequate attachment-type dozer blades for such smaller vehicles have not been known.

It is desirable to be able to operate the plowing vehicle at relatively high speeds and with a minimum number of sweeps through an area to clear it adequately. Thus, it is important for the blade design to facilitate snow removal while at the same time being durable to withstand high speed movement across roadbeds. As discussed above, efficient designs are further used to reduce the energy required to doze the snow, which is particularly important in commercial plowing operations.

OBJECTS OF THE INVENTION

The principal objects of the invention are: to provide a dozer blade for moving materials; to provide such a blade which is especially useful for plowing snow; to provide such a blade which has a straight line scraper along a bottom portion and an upper winged pointed formation for facilitating discharge of the snow; to provide such a blade which has a central divider for directing snow to both sides of the blade; to provide such a blade which converges forwardly and toward a center of said blade such that the blade top portion is generally situated forwardly of the blade scraper portion when the blade is in an operative position; to provide such a blade which exhibits a stable, energy efficient design; to provide such a blade which is relatively easy to use, economical to manufacture, and particularly well adapted for the proposed usage thereof.

Other objects and advantages of this invention will become apparent from the following description taken in conjunction with the accompanying drawings wherein are set forth, by way of illustration and example, certain embodiments of this invention.

SUMMARY OF THE INVENTION

A dozer blade as shown herein preferably includes two curved "mirror image" blade sections that are joined along a central juncture at respective inner ends thereof. The blade sections are joined to form a unitary blade exhibiting a concave surface for scraping and removal of snow and the like. The blade sections converge forwardly toward the central juncture, resulting in a top portion of the central juncture being positioned forwardly of a bottom portion thereof. Additionally, the top portion of the central juncture is generally positioned lower than outer ends of respective top portions of the blade sections, presenting a V-shaped, or winged, formation when viewed from the front. A central divider or rib is attached to the blade along the central juncture from a bottom scraping portion of the blade sections to the top. The divider generally serves to distribute material being dozed equally to either side. The forward winged formation of the blade sections, together with the divider, tend to remove snow and other materials to be dozed in an efficient manner.

In an alternative embodiment, the divider can be made to be removable to allow for angling of the dozer blade.

Preferably, and contemporaneously with the converging curvature of the blade sections, a straight line bottom scraper is angled so that it has the ability to dig into the subject grading surface without additional downward pressure.

The stable design of the present system reduces the stress on the vehicle, thus reducing the size of vehicle necessary to move relative amounts of snow and other materials. It has been found that the present design efficiently lifts snow and discharges it laterally from both sides, this keeps snow from rolling or piling up in front of the blade, which would cause additional stress on the vehicle and decrease the vehicle stability. In short, the present blade has exhibited the ability to plow through deeper snow with lower energy requirements. The forwardly projecting center board divider and outwardly deflected blade sections encourage snow to be released out of the top corner of the opposed blade sections, which facilitates maximum throwing distance of the snow to clear the pathway better.

The drawings constitute a part of this specification and include exemplary embodiments of the present invention and illustrate various objects and features thereof.

DETAILED DESCRIPTION OF THE INVENTION

Figure 1:
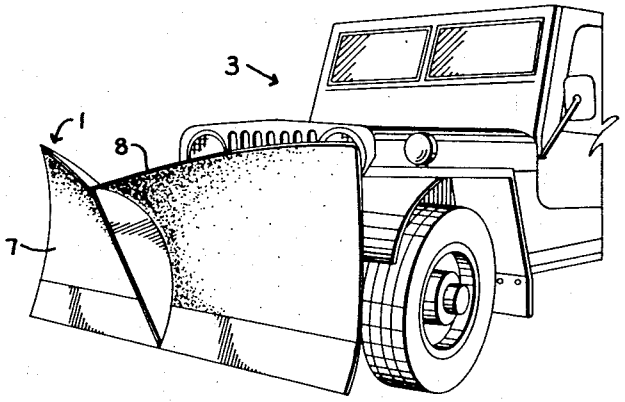
FIG. 1 is a perspective view of a dozer blade according to the present invention, showing the blade mounted on a plowing vehicle.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring in more detail to the figures, reference numeral 1 depicts a dozer blade apparatus according to the present invention. The dozer blade 1 is operatively connected to a plowing vehicle 3 by connection means 5.

The dozer blade 1 includes a body having a first blade section 7 and a second blade section 8. The first and second blade sections 7 and 8 have respective first and second inner ends 10 and 11 and respective and first and second outer ends 12 and 13. Further, each blade section 7 and 8 has a respective top portion 15 and 16 and bottom portions 17 and 18.

The first and second blade section inner ends 10 and 11 are joined along a central juncture 20 to form a unitary blade. Specifically, the first and second blade sections 7 and 8 are preferably welded along the central juncture 20. A central divider 25 is welded to the dozer blade 1 along the central juncture 20, as seen in profile in FIG. 3. If desired, the central divider 25 can be removably connected to the dozer blade 1, to allow for possible angling of the dozer blade 1 for specific operations.

The first and second blade sections 7 and 8 have respective front surfaces 27 and 28 and rear surfaces 29 and 30. As used herein, "front" refers to the surface that faces away from the plowing vehicle 3, when the dozer blade 1 is in an operative position thereon. Consequently, the term "rear" refers to the surface that faces toward the plowing vehicle 3.

First and second straight line scrapers 37 and 38 are removably attached to the first and second blade section bottom portions 17 and 18, respectively. The removable scrapers 37 and 38 are periodically replaced as they wear down during use.

Figure 2:
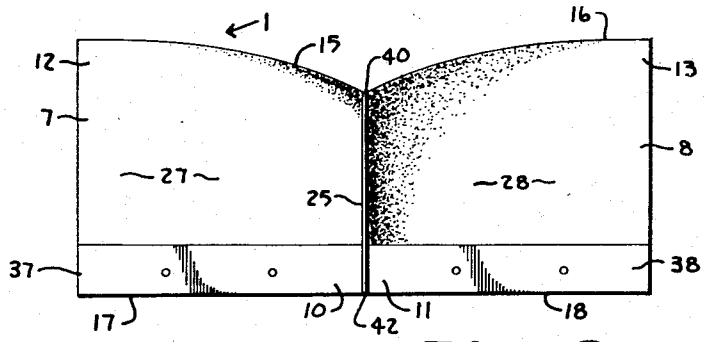
FIG. 2 is a front elevational view of the dozer blade.
Figure 4:
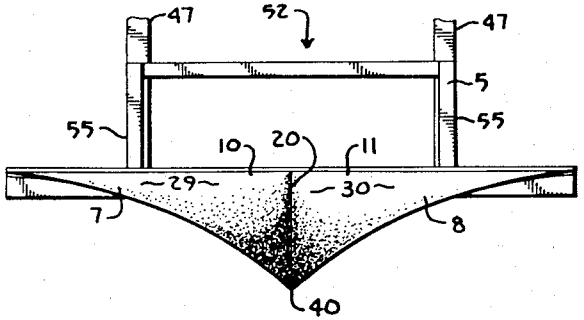
FIG. 4 is a fragmentary top plan view of the dozer blade and connection means.
Figure 5:
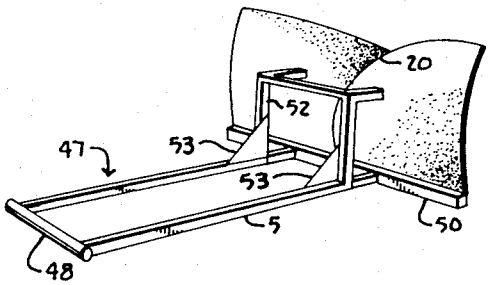
FIG. 5 is a rear perspective view of the dozer blade and connection means, showing both on a reduced scale.

The first and second blade sections 7 and 8 are generally formed to be mirror images of one another, as seen in FIGS. 2 and 4. Each blade section 7 and 8 is curved from the respective bottom portions 17 and 18 to the top portions 15 and 16, such that the front surfaces 27 and 28 are generally concave and the rear surfaces 29 and 30 are generally convex.

Figure 3:
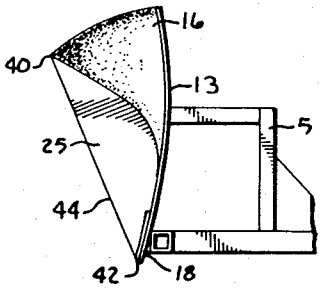
FIG. 3 is a fragmentary, side elevational view of the dozer blade and associated means for connecting the blade to the plowing vehicle.

In order to facilitate discharge of the plowed material, the blade section top portions 15 and 16 are formed to present a V-shaped, or winged, pointed formation, as best seen in FIGS. 2 and 4. The winged outline results from a convergence of the respective blade sections 7 and 8 downwardly and forwardly as they approach the central juncture 20. As a result of this convergence, a top point 40 of the central juncture 20 is positioned forwardly of a bottom point 42 of the central juncture 20 when the blade 1 is in an operative position on the plowing vehicle 3. The divider 25 extends between the central juncture top point 40 and bottom point 42 and defining a chord 44 therebetween. Thus, as seen in FIG. 3, the central divider is of an irregular semi-oval shape conforming to the front surface of the central juncture 20.

The forwardly projecting central divider 25 and the outwardly deflected blade sections 7 and 8 facilitate division and discharge of the plowed material. In use, it has been seen that snow is generally discharged straight out of the top corner of the respective blade section outer ends 12 and 13.

The connection means illustrated herein include a pair of elongate longitudinal frame members 47, which terminate in a rearward pivot member 48 positioned transverse to the frame members 47. A forward end of each longitudinal frame member 47 is attached to a reinforcing member 50, which is attached to and runs along the blade section first and second bottom portions 17 and 18.

For further support of the blade 1, an upper bracing apparatus 52 is provided, together with a pair of supporting gussets 53. The bracing apparatus extends upwardly from the longitudinal members 47, and opposed extension members 55 are attached to respective rear surfaces 29 and 30 of the first and second blade sections 7 and 8.

The connection means are adapted for pivotal connection to the plowing vehicle 3. As illustrated herein, the rearward pivot member 48 is connected to an appropriate apparatus (not shown) on the plowing vehicle 3, at a rearward position along the bottom part of the chassis. The bracing apparatus 52 is connected to a winch or the like (not shown) attached to the plowing vehicle 3, as is well known in the art. The winch is used to actuate the bracing apparatus 52 and consequently the dozer blade 1 about an axis defined by the pivot member 48. In this manner, the dozer blade 1 can be elevated during transport from plowing area to plowing area.

It is to be understood that while certain forms of the present invention have been illustrated and described herein, it is not to be limited to the specific forms or arrangement of parts described and shown.

I claim:

1. A snow dozer blade adapted to be connected to a self-propelled vehicle and having a normal directon of travel associated with movement of the vehicle; said blade comprising:

(a) a body having a central juncture opposed outer ends and a top and a bottom portion having a bottom edge; said body being centrally curved from top to bottom and substantially colinear from end to end along said bottom portion to form mirror image first and second blade sections joined at said central juncture; said outer ends having substantially less curvature and being substantially vertical when said blade is in an operative position with said bottom edge perpendicular to the normal direction of travel of said blade;

(b) said body coverging forwardly at the top from said opposed outer ends toward said juncture extending and forwardly of said bottom portion such that a substantial part of said body top portion is said positioned forwardly of said bottom portion when said blade is in an operative position; and (c) a central divider attached to a front surface of said blade along said central juncture, said central divider extending from said top portion to said bottom portion, whereby material being dozed is divided for discharge from either end of said blade.

2. A dozer blade apparatus movable in a forward direction for dozing snow and the like comprising:

(a) a first blade section having an inner end and an outer end;

(b) a second blade section having an inner end and an outer end; said first and second blade sections being mirror images of each other and having said respective inner ends attached at a central juncture to form a unitary blade; said first and second blade sections being curved upwardly from a bottom scraper section of said blade; said outer ends having substantially less curvature than said central juncture and being generally vertical when said blade is in an operative position with said bottom scraper section perpendicular to said forward direction;

(c) said first and second blade sections converging and being substantially curved near said inner ends thereof such that a top portion of said central juncture is positioned forwardly of a bottom portion of said central juncture when said blade is in said operative position; and (d) said blade section bottom portion joining so as to form a substantially colinear lower scraping edge from end to end.

3. The dozer blade apparatus as set forth in claim 2 wherein:

(a) a central divider attached to a front surface of said unitary blade and extending between said central juncture top and bottom portions, whereby material being dozed by said blade is generally equally divided between said first and second blade sections; and (b) said blade section top portions are curved forwardly toward said central juncture to exhibit a winged formation.

4. The dozer blade apparatus as set forth in claim 2 wherein said central divider is generally semi-oval in shape corresponding to the forward curvature of said central juncture and defining a chord between said central juncture top portion and said central juncture bottom portion.

5. The dozer blade apparatus as set forth in claim 2 further including means connecting said dozer blade to a plowing vehicle.

6. A snow dozer blade apparatus movable in a forward direction comprising:

(a) a support frame adapted to be secured to a self propelled vehicle;

(b) a first blade section having an inner end and an outer end;

(c) a second blade section having an inner end and an outer end; said first and second blade sections being attached at a central juncture of said inner ends to form a unitary blade; said first and second blade sections being substantially curved upwardly and forwardly from the bottom of each respective blade section near said juncture;

(d) lower edges of each of said blade sections being relatively straight and joined at said juncture to define a bottom scraper; said bottom scraper being substantially colinear along the entire bottom of said blade;

(e) said first and second blade sections converging forwardly toward said central juncture such that a top portion of said central juncture is positioned forwardly of a bottom portion of said central juncture when said blade is in an operative position with said bottom scraper perpendicular to said forward direction;

(f) said blade section outer ends being curved substantially less than said central juncture and being substantially upright when said blade is in said operative position thereof;

(g) a central divider attached to a front surface of said unitary blade and extending from said top portion to said bottom portion, whereby material being dozed by said blade is generally equally divided between said first and second blade sections.

* * * * *